US006035501A

United States Patent [19]

Bisping et al.

[11] Patent Number: 6,035,501

[45] Date of Patent: Mar. 14, 2000

[54] METHOD OF MAKING A SUBCALIBER KINETIC ENERGY PROJECTILE

[75] Inventors: Bernhard Bisping, Ratingen-Hösel; Ulf Hahn, Ratingen; Wolfgang Stein, Hermannsburg, all of Germany

[73] Assignee: Rheinmetall W & M GmbH, Ratingen, Germany

[21] Appl. No.: 09/310,571

[22] Filed: May 12, 1999

Related U.S. Application Data

[62] Division of application No. 08/855,970, May 14, 1997, Pat. No. 5,936,191.

[30] Foreign Application Priority Data

May 14, 1996 [DE] Germany ..... 196 19 341

[51] Int. Cl.[7] ..... F42B 33/00

[52] U.S. Cl. ..... 29/1.23; 102/519

[58] Field of Search ..... 29/1.2, 1.22, 1.23; 102/501, 514–519, 520, 521, 523

[56] References Cited

U.S. PATENT DOCUMENTS

| | | | |
|---|---|---|---|
| 2,393,648 | 1/1946 | Martin | 102/519 |
| 4,044,679 | 8/1977 | Pagano et al. | 102/517 |
| 4,619,203 | 10/1986 | Habbe | 102/517 |
| 4,638,738 | 1/1987 | Bisping et al. | 102/517 |
| 4,665,828 | 5/1987 | Auer | 102/520 |
| 4,970,960 | 11/1990 | Feldmann | 102/517 |
| 5,223,667 | 6/1993 | Anderson | 102/517 |

FOREIGN PATENT DOCUMENTS

| | | |
|---|---|---|
| 0 073 385 | 3/1983 | European Pat. Off. . |
| 0 392 084 | 10/1990 | European Pat. Off. . |
| 32 42 591 | 5/1984 | Germany . |
| 39 19 172 | 12/1990 | Germany . |
| 41 41 560 | 6/1993 | Germany . |
| 42 14 873 | 11/1993 | Germany . |

*Primary Examiner*—Harold J. Tudor
*Attorney, Agent, or Firm*—Venable; Gabor J. Kelemen

[57] ABSTRACT

A method of making a subcaliber kinetic energy projectile includes the following consecutive steps: friction-welding a light-metal blank to a frontal end face of a tungsten heavy metal penetrator core, wherein the blank is overdimensioned relative to the penetrator core; and forming a conical projectile tip from the blank.

4 Claims, 1 Drawing Sheet

METHOD OF MAKING A SUBCALIBER KINETIC ENERGY PROJECTILE

CROSS REFERENCE TO RELATED APPLICATIONS

This application is a division of pending U.S. patent application Ser. No. 08/855,970 filed May 14, 1997 now U.S. Pat. No. 5,936,191.

BACKGROUND OF THE INVENTION

The invention relates to a method of making a subcaliber kinetic energy projectile having a penetrator which has a cylindrical portion adjoined by a conical frontal portion that forms the projectile tip.

Frequently, in front and on the sides of armored vehicles the armor is at a substantial inclination to the vertical to cause the armor-piercing kinetic energy projectiles to glance off the hard armor plates upon impacting.

It is generally known to provide the front end of kinetic energy projectiles which, as a rule, are made of tungsten heavy metal, with a "biting edge" for preventing the projectile from sliding off the inclined armored plates. Since the flight behavior of the projectile must not be adversely affected by the biting edge, the known projectiles have in front a hood-like aluminum tip (ballistic hood) which is pressed or screwed on the penetrator body (also referred to as the penetrator core).

It is a disadvantage of such known kinetic energy projectiles that in the region where the penetrator core is connected with the ballistic hood, the penetrator core must have a smaller diameter with respect to its remaining zones to ensure that the ballistic hood, when in place, has the predetermined caliber of the projectile. It was found that particularly in small or mid-caliber armor-piercing ammunition as used in automatic guns these known connecting modes of the projectile tip and the penetrator core do not yield an optimal biting and penetrating behavior of the projectile in case of significantly inclined armor. Such a phenomenon may be, among others, derived from the fact that the frontal, stub-shaped region of the penetrator often breaks off upon impacting and the subsequent (rearward) penetrator region no longer impinges in a defined manner on the surface of the armor.

Further, in the known kinetic energy projectiles a relatively high technological input is required for attaching and centering the hood-like aluminum tip because appropriate threads must be cut or expensive fittings have to be resorted to.

It is known from German Offenlegungsschrift (application published without examination) No. 32 42 591 to secure a projectile tip, made of a high proportion of tungsten, to the penetrator core by hard soldering or diffusion sintering. When using such a securing process to attach an aluminum projectile tip to a tungsten heavy metal penetrator core, it was found that because of the formation of heat zones the penetrator core undergoes microstructural changes in the connecting region. As a result, the penetrator breaks relatively easily in the connecting region with the projectile tip upon impacting on an inclined armored plate, and consequently, an undefined biting behavior of the penetrator core will occur.

German Offenlegungsschrift 39 19 172 discloses a kinetic energy projectile having a penetrator in which instead of a frontal ballistic hood inserted on the penetrator core, a protective coat having a projectile tip is provided which encloses the entire penetrator core. The manufacture of such a projectile, however, involves an extraordinarily high technological input.

German Offenlegungsschrift No. 41 41 560 describes a kinetic energy projectile having a penetrator in which the penetrator core is connected by means of a frictional weld with a rearwardly disposed aluminum guide body. In this conventional structure too, the projectile tip is connected with the penetrator core by means of a stub-like extension thereof. Upon impingement on an inclined armor plate, the penetrator core is very likely to break in the frontal connecting region and would therefore have a non-reproducible biting and penetrating behavior.

SUMMARY OF THE INVENTION

It is an object of the invention to provide an improved method of making a subcaliber kinetic energy projectile having a tungsten heavy metal penetrator and a light-metal projectile tip which may be manufactured in a very economical manner and whose penetration through inclined armored plates having a predetermined large angle of inclination is greater than that of the known comparable kinetic energy projectiles.

This object and others to become apparent as the specification progresses, are accomplished by the invention, according to which, briefly stated, the method of making a subcaliber kinetic energy projectile includes the following consecutive steps: friction-welding a light-metal blank to a frontal end face of a tungsten heavy metal penetrator core, wherein the blank is overdimensioned relative to the penetrator core; and forming a conical projectile tip from the blank.

In essence, the invention is based on the principle to connect the tungsten heavy metal penetrator core with a light-metal projectile tip made of solid material by means of a friction weld, and thus an attachment of the projectile tip by means of a thread and an expensive fitting may be dispensed with. Aluminum and/or magnesium alloys were found to be particularly adapted as light metals.

It has been surprisingly found that the high bending torques generated in the region of the connection between penetrator core and projectile tip upon impingement on the inclined armored plate have not lead to any breakage of the penetrator in that region despite the damping effect of the light metal tip. Tests have confirmed that—unlike in case of hard soldering or diffusion heating—in the tungsten heavy metal penetrator core practically no significant effect of the friction weld on the microstructure of the penetrator core was detectable which would lead to microstructure changes enhancing the breakage of the penetrator.

Further, by virtue of the kinetic energy projectile according to the invention, upon impacting on an inclined armored plate a damping of the impact on the frontal face of the penetrator occurs by virtue of the relatively soft, solid light metal tip.

Further, after the disintegration of the light-metal tip, the still-integral frontal surface of the penetrator core impacts with its sharp biting edge on the inclined flat armor, and the biting edge prevents the penetrator from glancing off the armored plate.

By virtue of the defined "biting" of the projectile according to the invention, particularly in case of a significantly inclined armor plate (even at an angle of 70_ to the vertical), a significantly higher penetration performance of the penetrator is obtained than with known penetrators having a ballistic hood or with penetrators which are connected with the projectile tip by means of a stub coupling.

Even in case of multiple-plate targets or reactive targets, the kinetic energy penetrators according to the invention have a better penetration behavior than known kinetic energy projectiles.

Further, tests have shown that the biting behavior of the penetrator may be improved by providing that the penetrator core is 5–20% harder in the region of its outer lateral surface than along its axial region.

To manufacture the projectile according to the invention in a simple but nevertheless effective manner, first a cylindrical, solid aluminum blank which is overdimensioned relative to the tip of the kinetic energy projectile is friction-welded to the tungsten heavy metal penetrator core. Thereafter, the projectile tip is machined from the light metal blank.

It has been found to be particularly advantageous to provide no chamfer on the frontal face of the penetrator core oriented towards the projectile tip before the friction welding process and therefore such frontal face has a very sharp edge. The radius of curvature in the edge zone of the frontal face should be equal to or less than 0.05 mm which may be achieved, for example, by a machining (turning) operation with a chip width of 0.1 to 0.3 mm.

By means of the turning operation an optimally large friction welding surface and thus an optimal friction weld between the penetrator core and the light-metal tip may be obtained. An additional subsequent turning of the penetrator after the friction welding process may be dispensed with. After forming the projectile tip by the turning operation, a gapless and jointless bond is obtained which has superior aerodynamic properties.

DESCRIPTION OF THE PREFERRED EMBODIMENT

Figure 1:
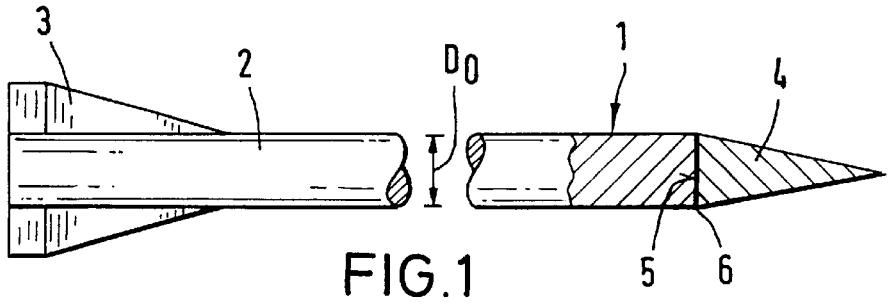
FIG. 1 is a side elevational view of a preferred embodiment of a kinetic energy projectile made with the method according to a preferred embodiment of the invention.

FIG. 1 shows a subcaliber kinetic energy projectile 1 which is composed of a tungsten heavy metal penetrator core 2, a rear guide assembly 3 attached to the penetrator core 2 and a frontal projectile tip 4. For clarity of illustration, the conventional central sabot surrounding the penetrator core is not shown.

The projectile tip 4 is formed of a solid body made of an aluminum alloy, such as AlMgSi 0.5 F22 and is, according to the invention, connected at an abutting joint region 5 with the penetrator core 2 by a friction weld 6. As may be seen in FIG. 1, the friction weld 6 is situated in a region in which the projectile 1 has reached its maximum diameter $D_0$ in the forward direction.

Figure 2:
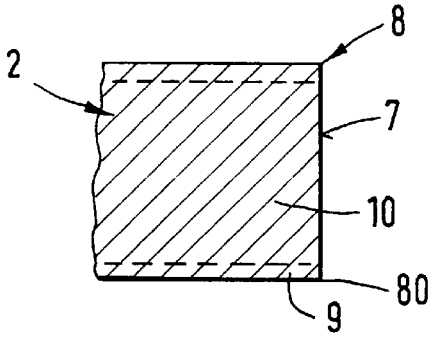
FIG. 2 is an enlarged sectional view of the surface of the penetrator core prior to welding it to the projectile tip.

For making the kinetic energy projectile 1 according to the invention, it has to be ensured prior to the friction welding process that the penetrator end face 7 oriented towards the projectile tip 4 is not chamfered at its edge, as shown in FIG. 2. The permissible radius of curvature 8 in this region should be smaller than or equal to 0.05 mm so that a very sharp edge periphery 80 is obtained.

As concerns the biting behavior of the penetrator core at the armored plate to be penetrated, it has further been found to be beneficial to provide that the outer, surface region 9 of the penetrator core is harder than the inner region 10 which includes the axis of the penetrator core. The hardness difference between the regions 9 and 10 should be between 5 and 20%. The outer region may have a hardness of 540 to 580 HV30.

Figure 3:
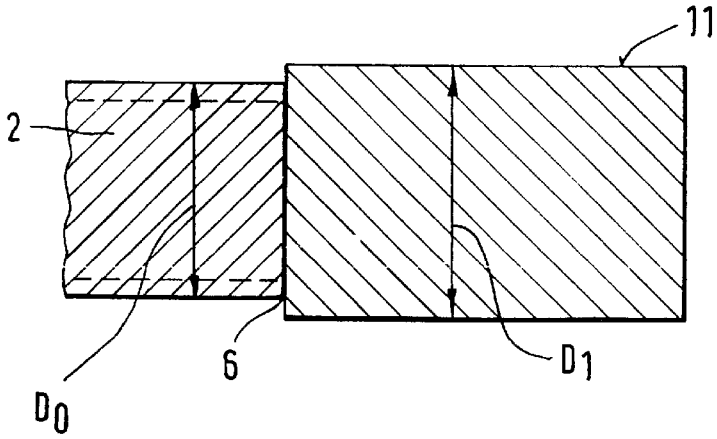
FIG. 3 is an enlarged sectional view of the end face of the penetrator core after welding it to the projectile tip blank, but prior to the shaping of the latter.
Figure 4:
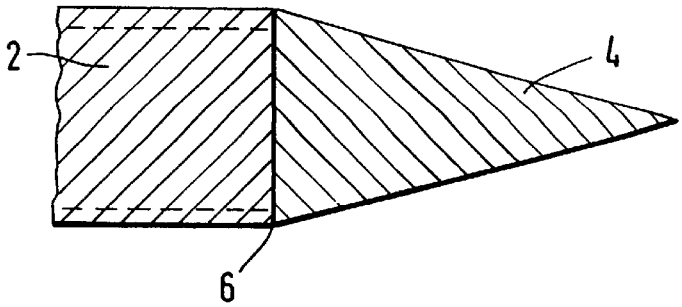
FIG. 4 is a view similar to FIG. 3, showing the projectile tip after shaping.

FIG. 3 shows a kinetic energy projectile prior to shaping the projectile tip 4. This structure is composed of a cylinder-shaped, solid aluminum blank 11 having a diameter $D_1$ and the penetrator core 2 having a diameter $D_0$ which is smaller than $D_1$. The penetrator core 2 and the blank 11 are attached to one another by friction welding. Subsequently, the blank 11 is turned on a lathe to obtain the conical projectile tip 4 as shown in FIG. 4.

It will be understood that the above description of the present invention is susceptible to various modifications, changes and adaptations, and the same are intended to be comprehended within the meaning and range of equivalents of the appended claims.

What is claimed is:

1. A method of making a subcaliber kinetic energy projectile comprising the following consecutive steps:

(a) friction-welding a light-metal blank to a frontal end face of a tungsten heavy metal penetrator core; wherein the friction-weld obtained is at a butt joint in which said blank and said penetrator core meet; said blank being overdimensioned relative to said penetrator core; and (b) forming a conical projectile tip from the blank.

2. The method as defined in claim 1, wherein said blank is a cylindrical body having a diameter greater than a diameter of said penetrator core.

3. The method as defined in claim 2, further comprising the step of forming, prior to step (a), a sharp-edged perimeter of said frontal end face; said perimeter having a radius of curvature of smaller than or equal to 0.05 mm.

4. The method of making a subcaliber kinetic energy projectile as defined in claim 3, wherein said step of forming a sharp-edged perimeter includes the step of chip-removal by lathing.

* * * * *